United States Patent [19]

Negus

[11] Patent Number: 5,018,454

[45] Date of Patent: May 28, 1991

[54] KNOCK-DOWN SEMI-RIGID TABLE ASSEMBLY

[76] Inventor: Fred W. Negus, 710 Oak St., P.O. Box 128, Fort Atkinson, Wis. 53538

[21] Appl. No.: 577,025

[22] Filed: Sep. 4, 1990

[51] Int. Cl.[5] ..... A47B 3/06

[52] U.S. Cl. ..... 108/150; 108/157

[58] Field of Search ..... 108/150, 157, 111, 153, 108/51.3; 312/259

[56] References Cited

U.S. PATENT DOCUMENTS

| | | | |
|---|---|---|---|
| 2,361,875 | 10/1944 | Sachs | 108/150 |
| 3,620,175 | 1/1970 | Crane et al. | 108/157 |
| 3,724,399 | 4/1973 | Notko et al. | 108/150 |
| 4,078,502 | 3/1978 | Barna | 108/150 |
| 4,267,998 | 5/1981 | Weirich | 108/153 |

*Primary Examiner*—Kenneth J. Dorner
*Assistant Examiner*—Gerald A. Anderson
*Attorney, Agent, or Firm*—Alfred E. Miller

[57] ABSTRACT

A knock-down table packaged in a flat carton and having a flat base member and table top. The base member is assembled by folding in the form of a tube having flaps and locking tabs for closing the bottom of the tube, and at the same time maintaining the tubular member in its assembled condition. The table top is provided with locking tabs on the bottom surface area which are inserted into slots adjacent to the top of the tubular member to form a set-up table.

8 Claims, 4 Drawing Sheets

KNOCK-DOWN SEMI-RIGID TABLE ASSEMBLY

The present invention relates to a semi-rigid table having a base or pedestal member, and a table top which is initially packaged in a flat condition in a relatively flat carton. The base member is provided with spaced locking tabs having short flaps therebetween while the table top is provided with a series of foldable flaps on the bottom surface thereof together with locking tabs on opposite flaps. The base member can be folded in the form of a tube, preferably hexagonal, in which the short flaps are folded inwardly to form a slot whereby the larger locking tabs are folded and inserted in the slot thereby forming an assembled tubular member. The flaps on the bottom of the table top are inserted in oppositely disposed slots in the top of the tubular member therein whereby a set-up table is constructed, which can be easily disassembled and unfolded and stored flat in the carton that it was originally packaged in.

BACKGROUND OF THE INVENTION

Paperboard tables are known as well as tables which are capable of being assembled quickly without fasteners or gluing such as shown in U.S. Pat. No. 3,620,175 to Crane et al and U.S. Pat. No. 4,267,998 to Weirich. The patent to Weirich, although capable of being shipped flat and in a compact form, requires two slotted leg member panels which are interlocked to form a supporting base and also incorporates four vertical brace panels as well as a top panel resting horizontally on the base. That construction requires additional members, as well as additional assembling steps, in order to construct a load supporting table. On the other hand, the patent to Crane et al discloses a paperboard table with the top having spaced panels with interlocking tabs. The tubular pedestal has a side edge with adhesive for gluing to the other side edge in order to transform the flat base member into tubular pedestal. This structure, once assembled, cannot be disassembled and stored or shipped in a flat condition as originally packaged, which is the case in the present invention. In contradistinction, the present invention contemplates the use of a corrugated base and table member which can be easily assembled and interconnected whereby a rigid structure is constructed with relatively few steps, and conversely the assembled table can be disassembled rapidly to its original flat condition so that it can be easily stored or transported, as required.

Since the bottom of the tube is enclosed by flaps and locking tabs a stable, or floor engaging surface is formed and the horizontally disposed table top can be removably secured to the top of the hollow base or pedestal by means of locking tabs. Thus, the entire unit has only two parts and is easily assembled and disassembled without the use of tools, and is thus reliable effective for the purpose intended.

In order that the invention may be more clearly understood, it will now be disclosed in greater detail with reference to the accompanying drawings, wherein:

DESCRIPTION OF THE PREFERRED EMBODIMENT OF THE INVENTION

Figure 1:
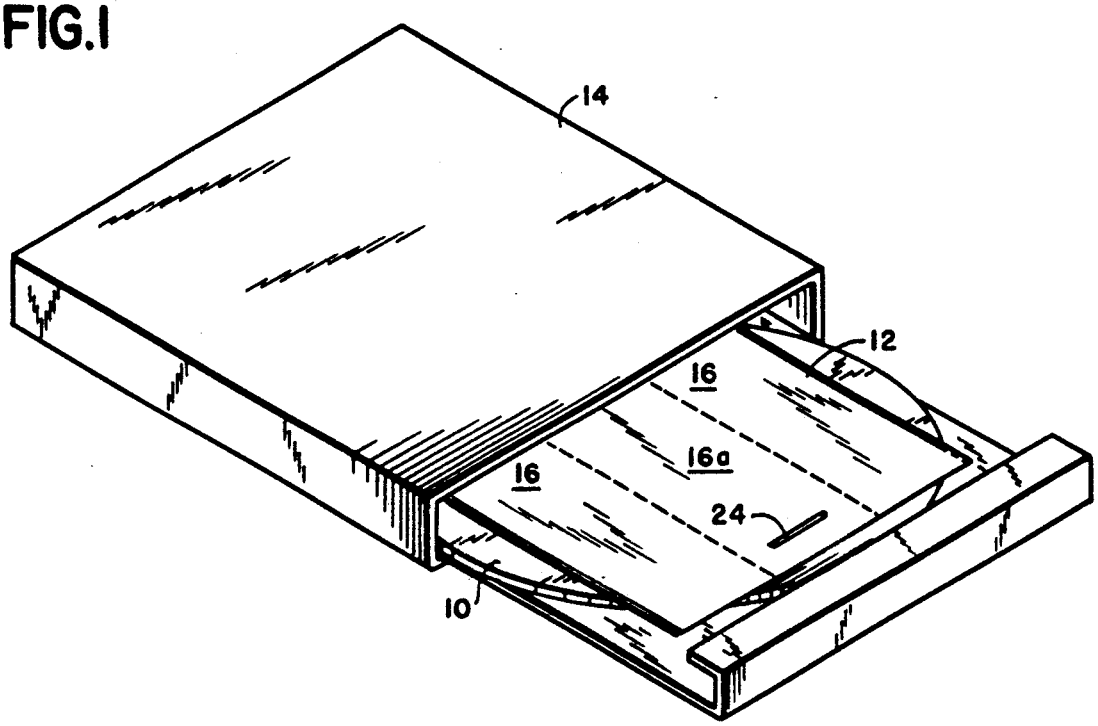
FIG. 1 is a perspective view of the semi-rigid base and table top in their flat, knock-down condition, as packaged in a flat box.
Figure 2:
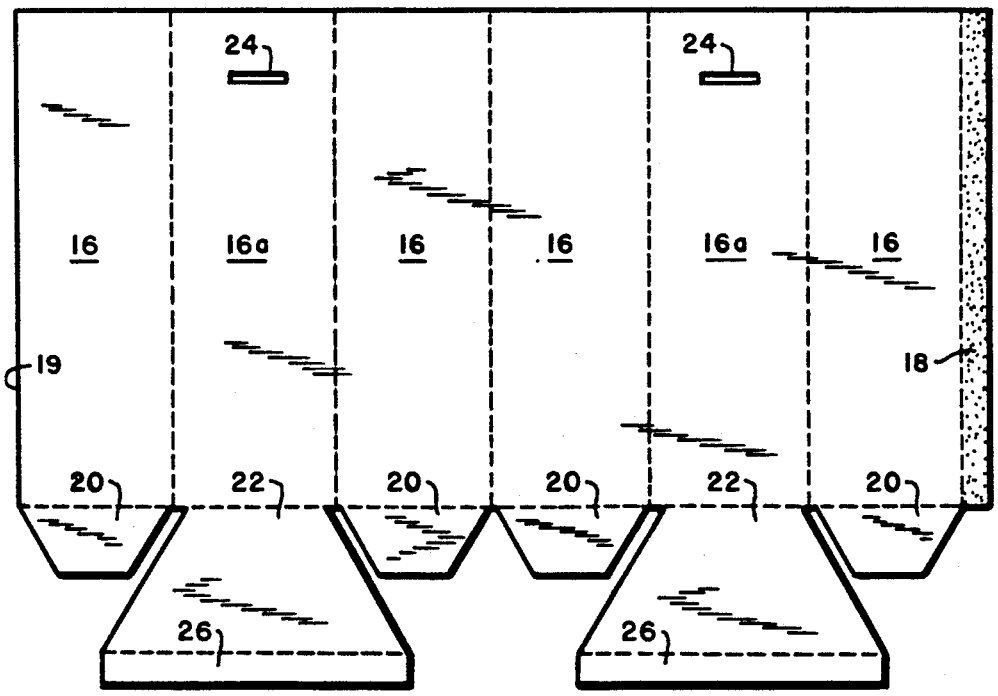
FIG. 2 is a top plan view of the base member in its original flat condition.
Figure 3:
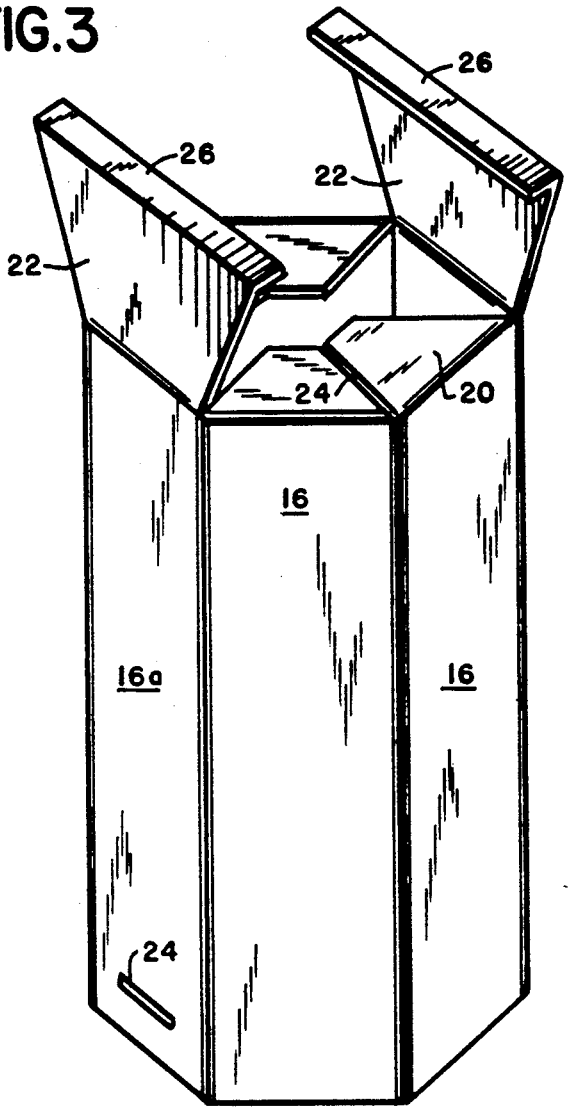
FIG. 3 is a perspective view of flat base member of FIG. 2 folded into a tubular form in which the flaps are bent inwardly.

As seen in FIG. 1 a semi-rigid table top 10 and base member 12 is shown which are preferably fabricated of a corrugated, foldable, heavy paper material which can be shipped and stored in a relatively flat condition in a flat carton 14. As seen in FIG. 2, initially the base member 12 is in a flat condition and is die cut with various flaps and locking tabs, as well as slots, to be described in detail hereinafter. A marginal edge 18 is provided with an adhesive and the flat base member 12 is folded over and doubled along the median line **16*b* and the adhesive edge 18 glued to the other marginal edge 19 of the base member. Consequently, the base member, when shipped and stored, assumes the condition shown in FIG. 1. Thereafter, the user, after removing the base member 12 from the carton 14, can erect the base member in the form of a hexagon by pushing out the side sections 16 and 16*a* so that the configuration shown in FIG. 3 is created. The base member is provided with plurality of sections 16, as well as the marginal edge 18. The sections 16 are provided with short flaps 20 while the sections 16*a* are provided with locking tabs 22. It should be noted that the flaps and locking tabs on the base member 12 are located on the bottom thereof, whereas the top of the base member is provided with spaced slots 24 on opposite sections 16*a***.

Figure 4:
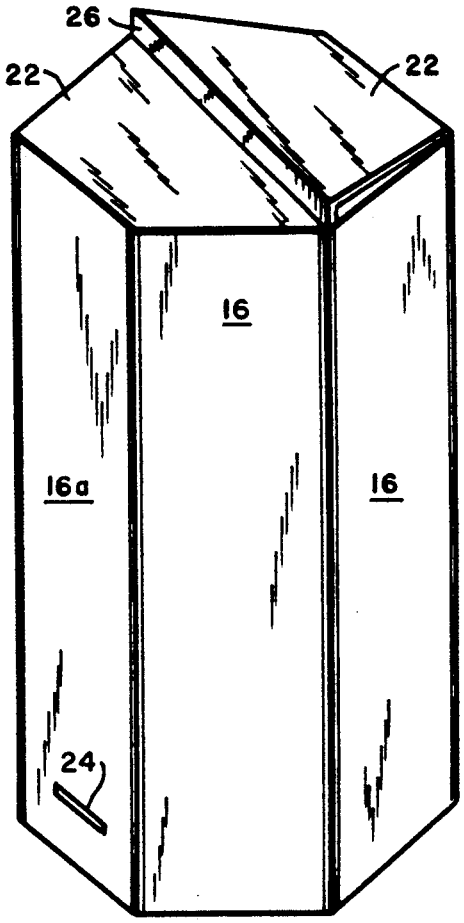
FIG. 4 is a top plan view of the partially folded base member seen in FIG. 3.
Figure 5:
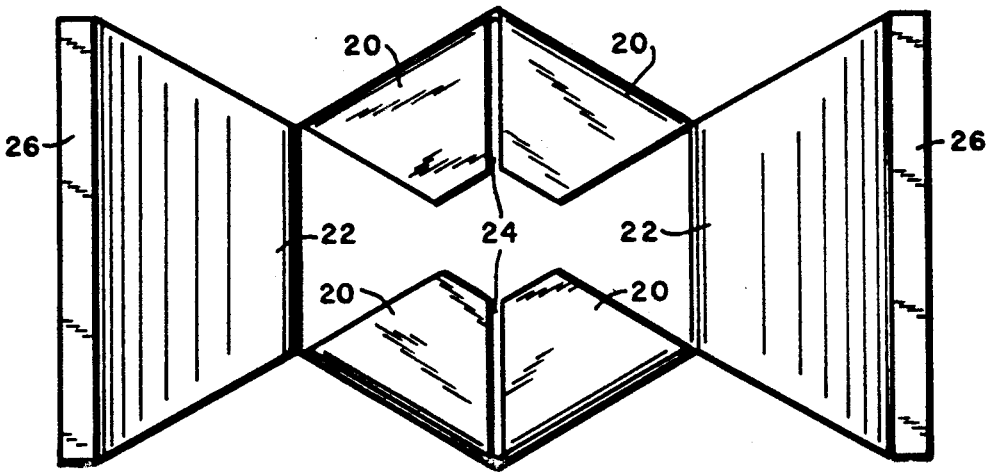
FIG. 5 is a perspective view of the base member in its inverted, folded condition in which the bottom of the tube is enclosed.
Figure 6:
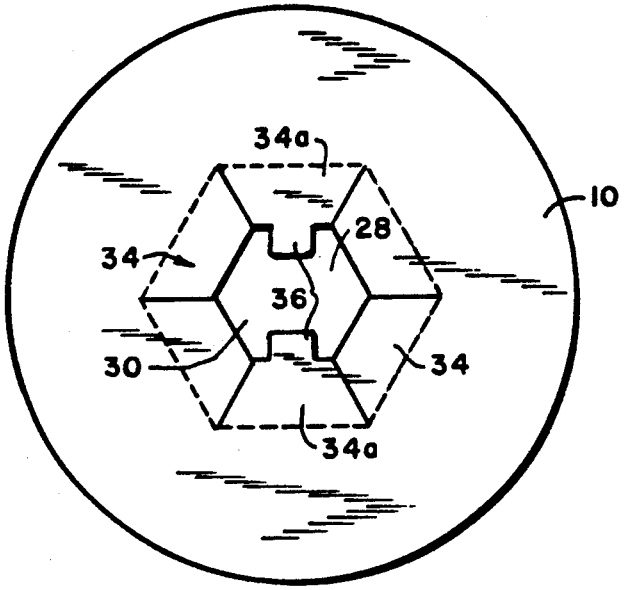
FIG. 6 is a bottom plan view of the table top in which the flaps and locking tabs are in a position which they are initially flat against the undersurface of the table top.
Figure 7:
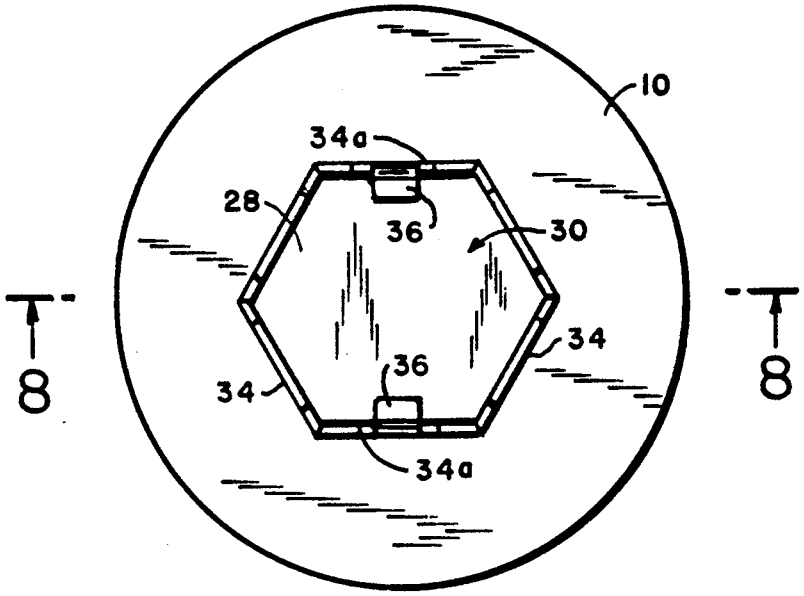
FIG. 7 is a bottom plan view of the table top in which the flaps are folded substantially at right angles to the plane of the table top.
Figure 8:
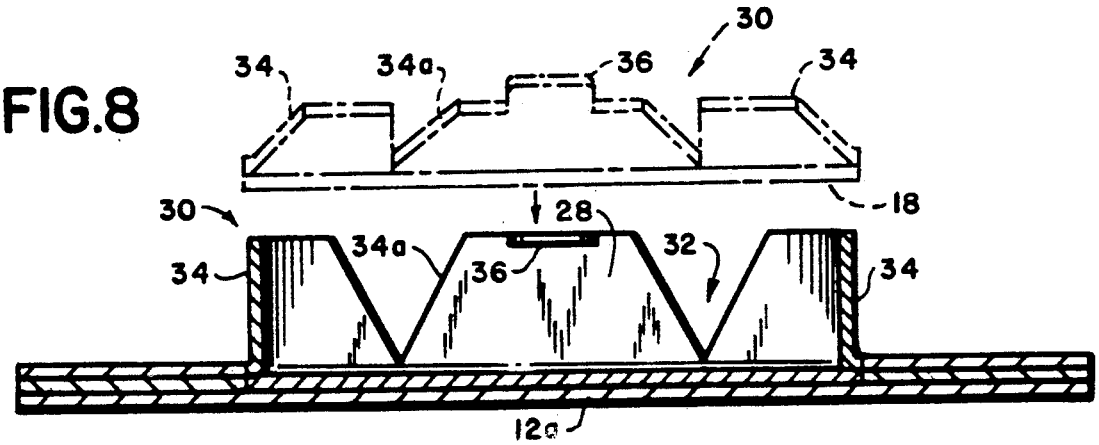
FIG. 8 is a view taken along the lines 8—8 of FIG. 7.
Figure 9:
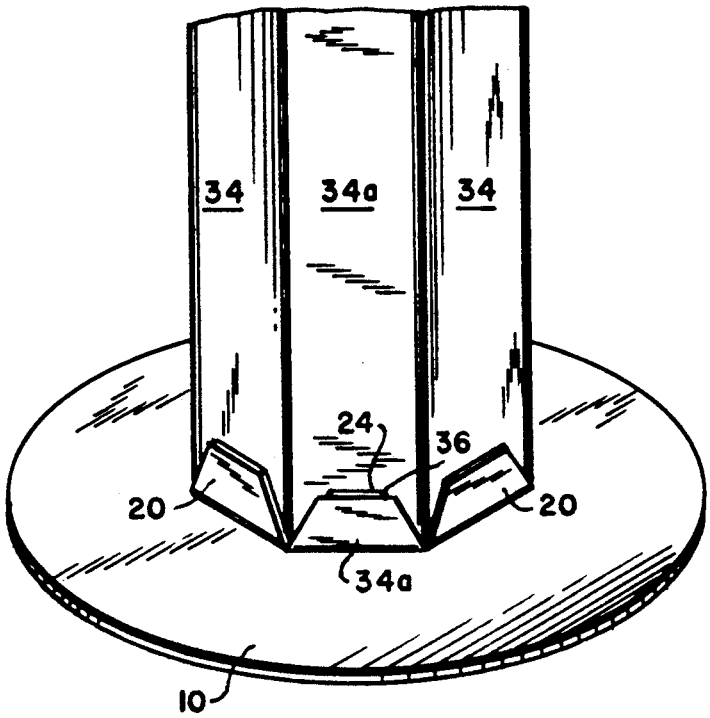
FIG. 9 is a perspective showing the flaps engaging side surfaces of the base member adjacent to the top with the locking tab in one of the slots thereof and, FIG. 10 is a perspective view of the completely assembled semi-rigid table constructed in accordance with the teachings of the present invention.

Referring now to FIGS. 3–5, it should be noted that the base member 12 is expanded into the form of a tube as described hereinabove and is shown in an inverted position configuration. Thereafter, the short flaps 20 are folded inwardly, as seen in FIG. 3 and 4, to form a slot 24 along the entire length of the opening of hollow hexagonal base member 12. The locking tabs 22 are provided with flaps 26 which are bent at right angles to the plane of the locking tabs 22 and inserted in the slot 24, as particularly seen in FIG. 5 of the drawings.

Referring now to FIGS. 6–9 the table top 12 is shown which is preferably of a three ply corrugated construction and has a smooth top surface and a central cut-out portion 28 in the form of a hexagon in which two of the three plies are cut away leaving a single ply **12*a*. A correspondingly shaped corrugated insert referred to by the reference numeral 30, which is of a double ply construction, is inserted into the opening 32 and glued to the bottom surface of the table top. Thus, the hexagonal insert 30 is provided with a plurality of flaps 34 as well as locking rabs 36 on opposite flaps 34a. It should be noted in FIG. 6 that initially the hexagonal insert 30 which is mounted in the opening 32 is flush with the bottom surface of the table top 10. However, if it is required to attach the table top to the base 12 the flaps 34 and 34a are folded away from the bottom surface of the table top to positions that are substantially perpendicular to the plane of the table top, as is clearly seen in FIG. 8, and the locking tabs 26 are folded inwardly towards each other substantially at right angles to the flaps 34 and 34a. Thereafter, the locking tabs 36 are inserted in the slots 24 on opposite sides thereof in the sections 16a of the base member 12. The remaining flaps 34 assume a position abutting the outer sides of the sections 16 adjacent to the top of the base member 12**.

Figure 10:
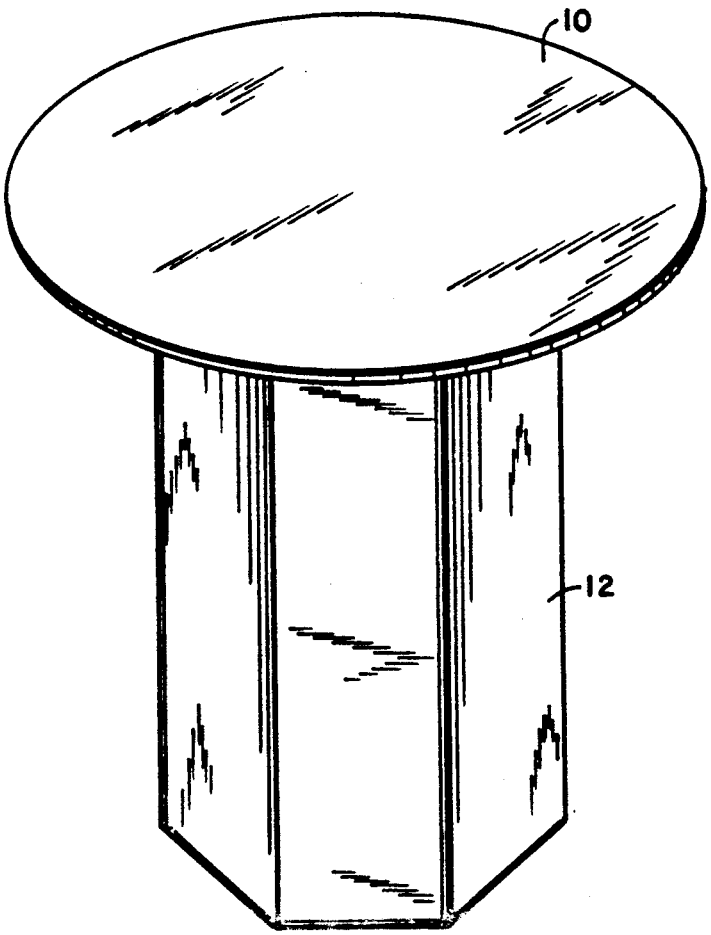

As seen in FIG. 10 the entire unit is shown assembled in which the base member 12 supports the table top 10. The structure is rigid when in use but can be disassembled for storing and transportation by removing the flaps 36 of the insert 30 on the underside of the table top from the slots 24 located on opposite sides of the tubular base. Thereafter, the bottom flaps 20 and 22 are unfolded from the bottom of the base member 12 and the base member is folded out into a doubled-over flat condition. Then the folded over and doubled base member can be inserted in the carton 14 together with the table top 10 for storage or transportation similarly as initially shown in FIG. 1.

It should be also noted that it is preferable to apply a coat of varnish or other water repellent liquid to both the top 10 and to at least part of the base member 12. As a result of the application of a protective coating both the top and base member become water resistant so that the table is appropriate for use for drinks as well as food items. It should be evident that the present knock-down table is portable, and can be assembled for use rapidly and also can be disassembled rapidly.

While the invention has been disclosed and described with reference to a certain embodiment, it is apparent that variations and modifications may be made which fall within the true spirit and scope of the invention as defined in the claims.

I claim:

1. A method of assembling a packaged knock-down semi-rigid table having a table top and a base member comprising:

removing said table top and base member both in a flat condition from said package, said base member in said flat condition having two spaced first locking tabs and a plurality of flaps therebetween, folding said base member to form a tubular base member folding opposing flaps on the bottom of said tubular base member inwardly to create a slot therebetween, folding said first locking tabs inwardly with the free edges thereof inserted in said slot thereby forming a closed bottom surface for said base member, providing slots on the opposite sides of said base member adjacent to the top thereof, said table top being provided with oppositely disposed flaps on the bottom surface thereof having second locking tabs, and inserting each of said second locking tabs in the respective slot in said base member thereby removably securing said table top to said base member.

2. The method as claimed in claim 1 further folding the free edges of each of said locking tabs substantially perpendicular to the remainder of said tab.

3. The method as claimed in claim 1 further applying a protective coat to said table top.

4. The method as claimed in claim 1 further applying a protective coat to said base member.

5. The method as claimed in claim 3 wherein said protective coat is varnish.

6. A knock-down table assembly having a hollow tubular base member and a table top for attachment to said base member, said table being fabricated of a semi-rigid foldable material, said base member having oppositely disposed first locking tabs and a plurality of flaps therebetween, said flaps being folded inwardly to form a slot therebetween, said locking tabs being inserted in said slot to thereby close the bottom end of said base member and to form a hollow tubular base member, the bottom of said table top being provided with flaps that can be bent away from the plane of the table wherein selected oppositely disposed flaps are provided with second locking tabs, said tubular base member being provided with correspondingly positioned side slots adjacent to the top thereof whereby said second locking tabs are inserted in said side slots in order to securely lock the table top to said base member.

7. A knock-down table assembly as claimed in claim 5 wherein said tubular base member is hexagonal.

8. A knock-down table assembly as claimed in claim 6 wherein said flaps when folded into positions substantially perpendicular to the plane of said table top forms an hexagonal opening for receiving the top of said hexagonal base member.

* * * * *